United States Patent [19]

Jaselli

[11] Patent Number: 4,588,976

[45] Date of Patent: May 13, 1986

[54] RESISTORS OBTAINED FROM SHEET MATERIAL

[75] Inventor: Franco Jaselli, Milan, Italy

[73] Assignee: Microelettrica Scientifica S.P.S., Milan, Italy

[21] Appl. No.: 673,168

[22] Filed: Nov. 19, 1984

[51] Int. Cl.[4] ..... H01C 3/10

[52] U.S. Cl. ..... 338/284; 338/217; 338/283; 338/289; 338/293; 219/552

[58] Field of Search ..... 338/195, 217, 218, 279, 338/280, 281, 283, 284, 287, 288, 289, 291, 293, 295, 314; 219/522, 528, 541, 543, 549, 552, 553

[56] References Cited

U.S. PATENT DOCUMENTS

| | | | |
|---|---|---|---|
| 497,795 | 5/1893 | Jenkins | 338/289 X |
| 1,498,969 | 6/1924 | Homan | 338/294 |
| 1,996,522 | 4/1935 | Norris | 338/289 X |
| 2,102,302 | 12/1937 | Arnold | 338/284 X |
| 2,721,920 | 10/1955 | Weide | 338/293 |
| 2,740,033 | 3/1956 | Perrine et al. | 338/281 X |
| 2,856,493 | 10/1958 | Fisher | 338/284 |
| 3,020,378 | 2/1962 | Eisler | 338/288 X |
| 3,283,284 | 11/1966 | Eisler | 338/283 X |
| 3,383,497 | 5/1968 | Harris | 338/195 X |
| 3,453,585 | 7/1969 | Croft et al. | 338/284 |
| 4,267,435 | 5/1981 | Best | 219/552 |
| 4,310,747 | 1/1982 | Rice et al. | 219/381 |
| 4,463,338 | 7/1984 | Utner et al. | 338/281 |

FOREIGN PATENT DOCUMENTS

| | | | |
|---|---|---|---|
| 893070 | 10/1953 | Fed. Rep. of Germany | 338/288 |
| 1479622 | 3/1967 | France | 338/284 |
| 317517 | 8/1929 | United Kingdom | 338/217 |
| 717390 | 10/1954 | United Kingdom | 338/287 |

*Primary Examiner*—Volodymyr Y. Mayewsky
*Attorney, Agent, or Firm*—Shlesinger, Fitzsimmons & Shlesinger

[57] ABSTRACT

These resistors are obtained from conductive sheet material, for example metal sheet material (usually referred to as "grids") in which additional plates are provided in order to distribute the current density and consequently to predetermine the temperature and strain distributions caused on the resistor during load conditions.

3 Claims, 3 Drawing Figures

RESISTORS OBTAINED FROM SHEET MATERIAL

This invention relates to an improvement on resistors obtained from conductive sheet material, for example metal sheet material (usually referred to as "grids") in which according to the invention additional plates are provided in order to distribute the current density and consequently to predetermine the temperature and strain distributions caused on the resistor during load conditions.

It is known to obtain resistors from flat metal sheet material in which, according to known techniques, by a simple mechanical operation is cut a plurality of parallel splits or slots, extending along a substantial part of said sheet.

Said slots start alternately from one side of the two lateral sides of the sheet, forming a resistor with a "zigzag" configuration.

Resistors obtained as above have the definite advantage of being noninductive, with a high dissipation surface area-to-material weight ratio, are economical and practical in use, but notwithstanding they suffer from several drawbacks.

In particular, an important limit to the utilization of said type of resistor is the nonuniformity of the temperature distribution occuring during operation, and this especially when the resistor is utilized for short term services and therefore with a high, or very high, energy dissipation during time intervals which are short or very short, even of the order of a fraction of a second. This is caused by the fact that the current which flows along a nonlinear conductor gathers so as to follow the minimum resistance path, giving rise to a plurality of spots or areas which are thermally overstressed. In the above resistors said areas are located near the end of the slots, that is in the inner part of the metal sheet, where the temperature reached during the operation is much higher than the average temperature of the sheet.

The establishment of said phenomenon gives rise to two important problems: a plurality of local damages in said areas of the conductive material, up to possibly the melting point, and the heat induced distortion of the resistor. More precisely, it has been noted that the longitudinal distortion of a resistor of said type is markedly higher than the distortion which a sheet with the same dimensions and without any cut would undergo.

This effect originates as a matter of fact from the overheating of the areas of material nearby the slot ends in the inner part of the sheet which provide the "zigzag" configuration of the resistor. Said effect causes the slots to straddle apart. As a matter of fact the temperature gradient in any area in which the conductor material has a sudden curvature causes an expansion of the internal fibers which is higher than that of the external fibers, and therefore such an area becomes distorted like a hinge. The sheet resistor as a whole undergoes therefore a longitudinal distortion like an accordion, because any sector element of the sheet opens with a turning movement having its center of rotation at a point near the internal end of the corresponding slot.

Due to the fact that the resistors in question are normally supported at their ends, their distortion causes a stress on the supporting points and as a consequence causes a bulging of the sheet resistor, which in practice is detrimental to the merit of being a flat piece amenable to be installed in a small volume.

Such a bulging of the resistors causes worse troubles, up to a complete unacceptability, in the case of stacked resistors when the bulgings can vary the mutual distance between adjacent resistors up to the contact in the case of two adjacent sheets assuming casually opposite curvatures.

For the above reasons there has been hitherto the necessity to utilize such resistors for operating currents much lower than the currents which seem quite acceptable as far as the real cross section of the conductor and the possibility of the material to withstand the thermal stress are concerned.

Hitherto, when it was necessary to foresee higher current densities, different types of resistors were utilized without the practical and economical merits of the sheet resistors in question.

The object of this invention is to eliminate the above drawbacks, and to permit to utilize in sheet resistors the full capability of their material, approaching as far as possible the maximum theoretical load which can be calculated on the basis either of the surface areas in the case of dissipation in steady state conditions, or on the basis of the thermal capacity of the material in the case of current pulse conditions, and in the latter case therefore substantially in adiabatic conditions.

According to this invention, it is proposed to obtain a resistor from a flat sheet of material having a plurality of slots which are cut alternately from opposed sides of the sheet and extend toward the inner part of the sheet to form a conductor with a configuration substantially of the "zigzag" type, characterized in that a plate is fastened with electrical conduction between the two areas at the sides of the terminal portion of the slot located in the inner part of the sheet.

The principle underlying this invention can be better understood in the general sense from the description of embodiments thereof which are given as examples only, and are illustrated in the accompanying drawing in which.

Figure 1:
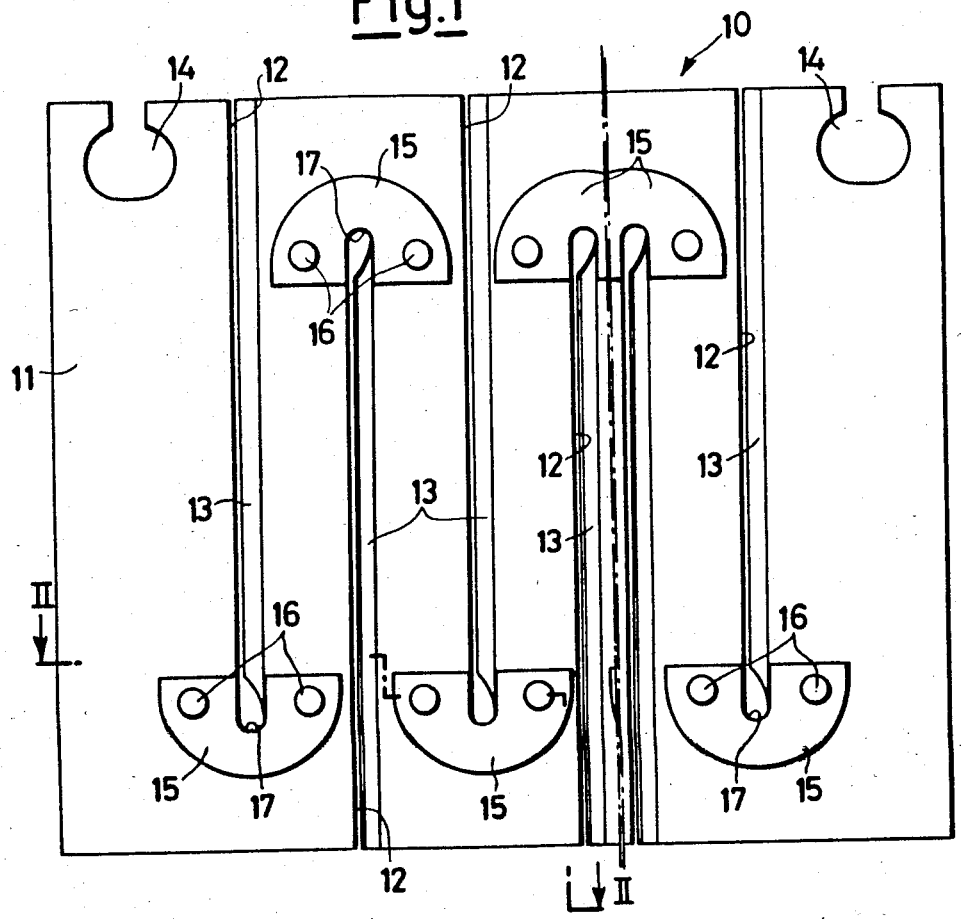
FIG. 1 is a plan view of a resistor obtained according to the invention.
Figure 2:
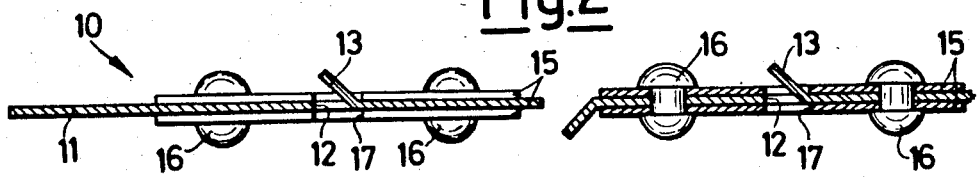
FIG. 2 is an enlarged sectional side view along the line ll—ll of FIG. 1.

With reference to FIGS. 1 and 2, a resistor according to the invention indicated generally with the reference numeral 10 is obtained from a flat sheet 11 of metallic material in which a plurality of mutually parallel slots 12 are cut by means of a known technique permitting a minimum of swarf.

Said slots 12 start alternately from two opposed sides of the sheet 11 and their edges are sufficiently spaced apart by bending, at least to some extent, one edge 13 of the slots 12.

Terminal means for electrical connection can be provided in various ways, for example by holes 14.

In particular, and according to the invention, two opposed plates 15 are fastened to the sheet material by means for example of rivets 16 to overlie the opposed surfaces of sheet 11 only in the areas which are adjacent or near the sides of the end 17 of the slots 12 and toward the inner part of the sheet 11, or immediately beyond the end 17 thereof.

The plates 15 have for example the same thickness as the sheet material onto which they are positioned.

The use of said plates has caused surprising result, since they practically have nullified or at least have reduced to a neglible extent the overheating which occurred previously, in some cases up to the melting point, in the areas where they had been attached. At the same time the applied plates caused a reduction down to a negligible extent of the longitudinal distortion of the sheet resistor heated by the current flow; in fact said distortion has been reduced to the value due to the linear distortion value pertaining to the material.

A resistor has been thus obtained such that, when subject to current flow, does not undergo to an additional distortion due to the change of the parallel configurations of the "zigzag" elements of the conductor.

It is to be noted the important fact that said result is not obtained in virtue of an effective mechanical fastening by means of rivets or the like, but on the contrary the effect is due to the possibility to correct the thermal operating conditions.

As a matter of fact, the areas or spots where the plates are applied become areas or spots respectively of less thermal stress, particularly if the electrical discharge applied to the resistor is of the pulse type, in which case the thermal capacity of the material is the agent controlling the termal behavior of the sheet, to be considered in this case as substantially adiabatic.

It is thus possible to avoided a problem which otherwise could be detrimental for those skilled in the art, that is the possibility of having the rivets or the like used for fastening subject to shear stresses depending on the thermal stress of the sheet and causing a weakening or detrimental modifications of the mechanical anchorage with induced electrical phenomena, such as scintillations, which could be dangerious or even destructive.

The provision of said plates or thickenings at the ends of the slots in the "zigzag" configuration of the sheet resistor permits the utilization of said resistor with electrical loads approaching the values allowed on a resistor obtained with a linear conductor with the same cross-section.

Figure 3:
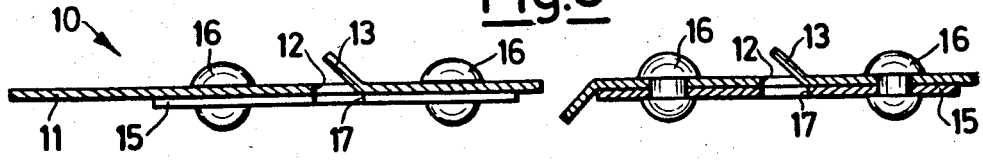
FIG. 3 is a view similar to FIG. 2, but of a different embodiment.

As shown in FIG. 3, the sheet resistor can be equipped with plates 15 on one side only of said sheet, with comparable advantages if the thickness of the plates is increased accordingly.

As far as the general dimensions of the plates are concerned, the plates obviously are roughly as wide as the conductor element in the areas where they are fastened to provide a suitable electrical contact (in the above described example they are fastened by means of rivets 16). In the intermediate area the plate should have a total cross-section as to withstand without overheating the current intended to flow, taking into account the heating effects on the resistor as a whole.

The material of the plates may be advantageously the same material of the sheet 10, also to the end of avoiding non congruent strains or the raising of parasitic electrical potentials.

The plates should preferably be juxtaposed on the areas of the conductor where the latter has its maximum curvature, that is on the inner end of slots 12.

The mechanical fastening which permits to the plates to be correctly connected both mechanically and electrically can be provided in different ways, all well known to those skilled in the art, though the riveting or the spot welding permits to obtain very good and effective results.

I claim:

1. An improved electrical grid resistor of the type comprising a thin, flat, metal sheet having a pair of spaced side edges, a first plurality of spaced slots in said sheet opening at one end on one of said side edges and extending from said one side edge transversely of said sheet and part way only toward the opposite side edge thereof, a second plurality of spaced slots formed in said sheet in spaced, alternating relation with said first plurality, each of said second plurality of slots opening at one end on said opposite side edge of said sheet and extending from said opposite side edge transversely of said sheet between an adjacent pair of said first plurality of slots, and part way only toward said one side edge of said sheet, and characterized by the fact that at least one each of a first plurality of spaced, electrically conductive plates is fastened in electrical contact with at least one surface of said sheet at the inner, closed end of each of said slots, each of said one plates overlying said one surface of said sheet only in the areas at the inner end of the associated slot and adjacent side portions thereof, each of said plates being generally semi-circular in configuration and having in the diametral side thereof a notch which is similar in configuration to, and which registers with, the inner end of the associated slot in said sheet, whereby the plate conforms to the configurtion of that portion of the sheet which is immediately adjacent to the inner end of the associated slot, including the areas at the sides of the slot.

2. An improved resistor as defined in claim 1, characterized in that each of said plates is connected to said sheet by means of rivets.

3. An improved resistor as defined in claim 1, characterized in that a second plurality of plates, which are similar in configuration to said first plurality of plates, are fasterned in electrical contact with the opposite surface of said sheet at the inner ends of said slots and in registry, respectively, with said first plurality of plates, whereby said sheet is sandwiched between said two pluralities of plates.

* * * * *